United States Patent [19]

Boone

[11] 3,943,859

[45] Mar. 16, 1976

[54] SHELF ATTACHMENT

[76] Inventor: Philip Boone, 15 Fenwick Road, Winchester, Mass. 01890

[22] Filed: Nov. 25, 1974

[21] Appl. No.: 526,963

[52] U.S. Cl. ..... 108/50; 108/27; 242/55.2; 248/204; 312/242

[51] Int. Cl.[2] ..... A47B 35/00

[58] Field of Search..... 242/55.2, 55.55, 55.53, 242/55.3; 211/5, 16; 312/242, 39; 108/27, 50; 248/27, 204; D6/97

[56] References Cited

UNITED STATES PATENTS

| | | | |
|---|---|---|---|
| 3,168,275 | 2/1965 | Grondin | 248/205 A |
| 3,409,340 | 11/1968 | Clark | 242/55.3 X |
| 3,709,576 | 1/1973 | Lemoine | 312/138 A |
| 3,799,467 | 2/1972 | Bauman | 4/1 X |
| 3,837,595 | 9/1974 | Boone | 242/55.3 |
| D232,606 | 9/1974 | Boone | D6/97 X |

*Primary Examiner*—James T. McCall

[57] ABSTRACT

A compact shelf-like device which is readily attachable to a standard toilet-tissue dispenser without need of special tools. The device is adapted to hold one or more toilet accessories conveniently.

10 Claims, 8 Drawing Figures

SHELF ATTACHMENT

BRIEF SUMMARY OF THE INVENTION

The subject invention is principally concerned with an attachment device providing a toilet-tissue dispenser with a shelf-like appurtenance for holding one or more items against displacement, e.g., items readily accessible and especially useful at that location such as a container of prewetted sheet material, a cleansing liquid, etc. The shelf, which may be open or include a cover, comprises a support or bracket portion which is adapted to firmly engage designated portions of a standard toilet-tissue dispenser composed, for example, of either a ceramic material or a metal. It may be installed readily so as to be positioned either above, below, or to the side of the roll of toilet-tissue, the choice depending upon the nature of the item borne and preference. The device may be composed of metal or a combination of metal and a plastic, and is so constructed as to provide a firm support.

In accordance with the foregoing considerations, objects of the invention are: to provide a sturdy shelf-like device for ready attachment to a standard toilet-tissue dispenser; to provide a device of the character described which comprises means for attachment to the conventional bores formed in the forwardly projecting posts of the toilet-tissue dispenser in a manner permitting normal installation or removal of a roll of paper; to provide a device which includes alternate means for engaging the dispenser posts; to provide a device as set forth while accomodates to differently shaped dispenser arms or bores of different diameter, to provide a device of the type stated which is adapted to support an item in either a vertical or horizontal position, held lightly or firmly; and to provide a device as characterized which, optionally, is essentially open, which includes side portions and which may include a cover. Other objects of the invention will in part be obvious and will in part appear hereinafter.

BRIEF DESCRIPTION OF THE DRAWING

The novel features which are believed to be characteristic of the invention are set forth with particularity in the appended claims. The invention, however, both as to its organization and its method of operation will best be understood from the following description when read in connection with the accompanying drawing wherein like numbers have been employed in the different figures to denote the same parts and wherein:

DETAILED DESCRIPTION

Figure 1:
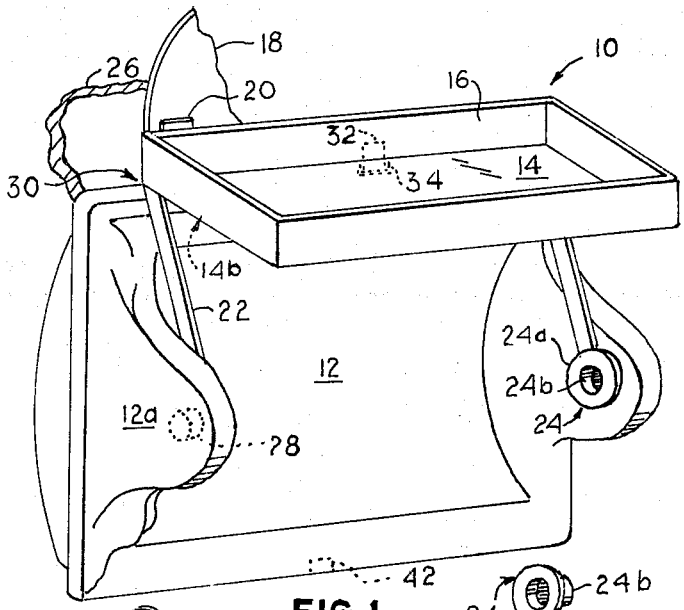
FIG. 1 is a diagrammatic perspective view of one form of the shelf-like device of the invention attached in a given manner to a toilet-tissue dispenser so as to be positioned above the latter.
Figure 2:
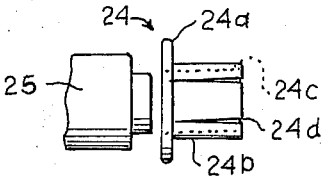
FIG. 2 is a side view of attaching means of FIGS. 1 and 4.

In FIG. 1 there is shown one form of the shelf-like device 10 of the invention mounted on a conventional toilet-tissue dispenser 12. The device 10 comprises the shelf or tray element 14 having side-walls 16, a cover 18 (optional) pivotally mounted at hinge 20, and mounting means therefor including a pair of elongated arms 22 firmly attached to shelf element 14 so as to extend downwardly at an acute angle. A grommet-like stud member 24, more particularly shown in FIG. 2, is fixedly attached to the lower extremity of each arm means 22, the shelf, arms and studs thus effectively constituting a unitary structure. The center of gravity of the device 10 is such that shelf element 14 is biased toward wall 26 on which the dispenser 12 is mounted or against a surface of the dispenser per se adjacent thereto.

As more clearly shown in FIG. 2, each stud member 24 comprises a ring section 24*a*, and a projecting eyelet section 24*b* integral therewith and including bore portions 24*c* adapted to accept the extremity of a standard paper-roll-bearing spindle 25. Stud member 24 is formed to firmly engage bore surface areas 28 of the posts 12*a*. Means for providing this firm engagement are exemplified by the split segments 24*d* or may include a resilient compressible surface material, an adhesive, etc.

Figure 3:
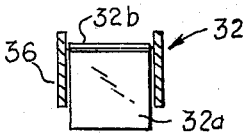
FIG. 3 is a front view of additional attaching means.

Means for holding or locking the shelf element firmly in place may include an adhesive, preferably pressure sensitive, at 30, or a tab element 32, integral with the device 10, which is adapted to be inserted behind the body of the dispenser 12 in a small slot 34 formed in the wall 26 or in the dispenser itself. FIG. 3 illustrates the tab element 32 as of a slidable type comprising the engaging tab component 32*a* having an overturned actuating end 32*b* mounted between guide portions 36 formed in the rear side-wall 16. Alternatively, the tab element may be of a fixed type attached to the shelf element 14 or to extremeties of the arms 22 and adapted to insertion in a slot or slots by manipulation of the entire device 10. The slot can be formed in either the wall or rear surface of the dispenser by a small file or other forming means in a matter of moments. The shelf element 14 and cover 18 may be composed, for example, of a suitable thermoplastic material such as a polycarbonate, ABS, etc. The arms 22 and stud members 24 are preferably composed of a metal such as a stainless steel, aluminum, or brass of an appropriate rigidity and strength.

Figure 4:
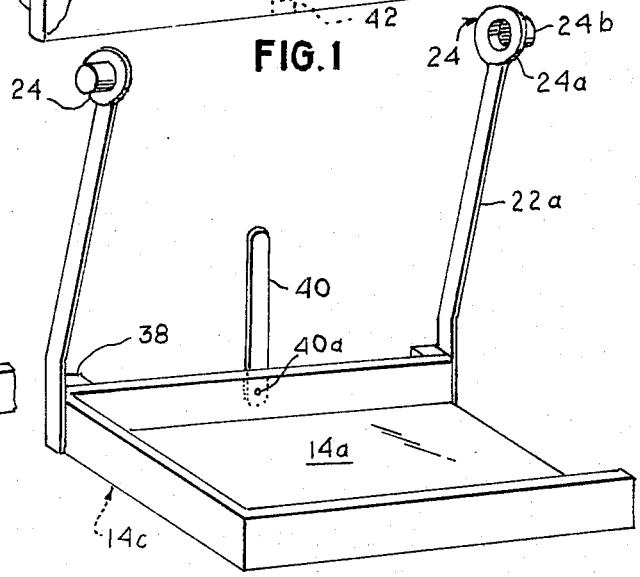
FIG. 4 is a diagrammatic perspective view of another form of the shelf-like device attachable to the dispenser of FIG. 1 to position the shelf below the dispenser.

In FIG. 4 there is illustrated an underslung mounting of the shelf element 14*a* adapted to attachment to the dispenser 12 of FIG. 1, the stud members 24 being identical to those above described and adapted to insertion in the bores 28 of the dispenser posts 12*a*. Pressure sensitive adhesive means may be located at 38 for holding the device in position or locking means such as an arm 40, pivoted at 40*a* and adapted to insertion of its extremity in a slot at 42 may be employed.

Figure 6:
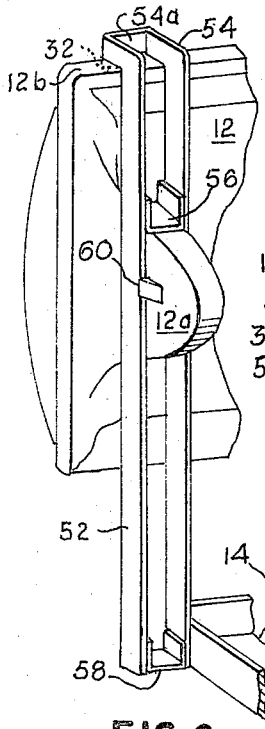
FIGS. 5 and 6 are fragmentary perspective views of alternate means for positioning the shelf element above or below the dispenser, respectively.
Figure 5:
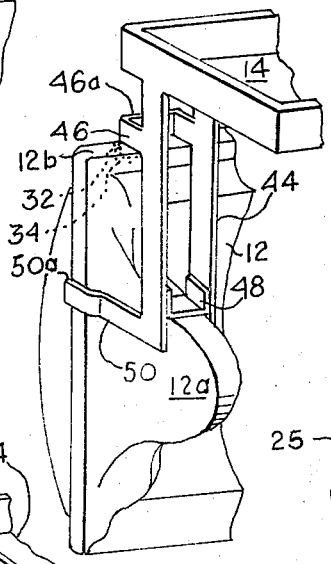

FIGS. 5 and 6 illustrate, respectively, modified means for mounting the shelf element above or below the toilet-tissue dispenser. The mounting means of FIG. 5 comprises a pair of elongated, vertically disposed arms 44 integral with and extending downwardly from shelf 14. A pair of short arms 46 project horizontally from the vertical arms and are interconnected at their extremities by a cross-piece 46*a*. Arms 46 and the cross-piece 46*a* upon the upper marginal area 12*b* of the dispenser. A cross-piece 48 interconnects the vertical arms adjacent to their lower extremities and bears upon the upper surface of the dispenser post 12*a*. A horizontal arm 50 having an overturned extremity 50*a* engaging the rear surface of the dispenser or a slot thereat provides a locking action against tilting of the shelf element. A tab element 32 engages a slot 34 behind or within the rear surface of the dispenser and constitutes additional holding or locking means. The entire device 10 can be installed readily by first slipping it downwardly into position and then fastening the tab 32 and arm 50 to anchor it firmly.

In FIG. 6 there is shown mounting means for the shelf element 14 comprising a pair of vertical arms 52, to at least one one of which is attached the shelf. A pair of short arms 54 extends horizontally from the vertical arms and are interconnected at their extremities by a cross-piece 54*a*. Arms 54 and the cross-piece bear upon the upper marginal area 12*b* of the dispenser. A tab 32 engages the rear surface of the dispenser in the manner previously described. A cross-piece 56 interconnects the vertical arms 52 and bears upon the upper surface of the dispenser post 12*a*. A second cross-piece 58 interconnects the lower extremities of the vertical arms. A positioning or locking lug 60 serves to hold the vertical arms against forward movement. Lug 60 may be in the form of a small tapered piece of plastic or other material bonded to the side surface of post 12*a*. The device is installed by sliding it downwardly and rearwardly into position.

For ultimate strength and rigidity, it is to be understood that the mounting means of FIG. 5 and 6 is duplicated relative to the other dispenser arm 12*a* (not shown) with the shelf element 14 extending horizontally between the pair of mounting means thus provided.

Figure 7:
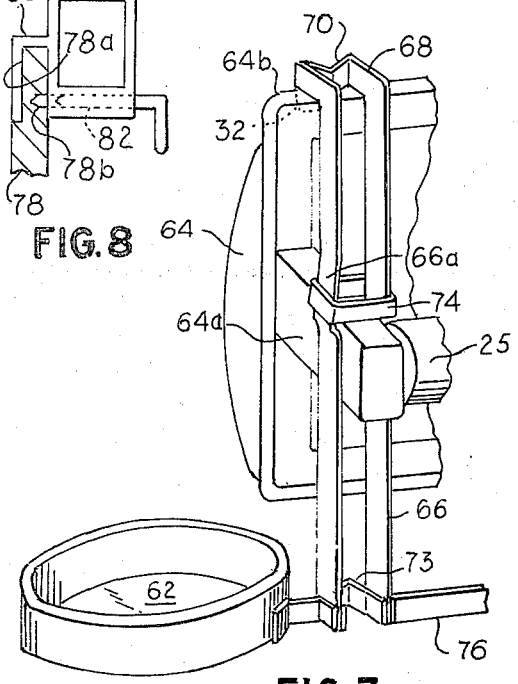
FIG. 7 is a fragmentary perspective view of a modified form of shelf element attached to the side of the dispenser.

In FIG. 7 there is illustrated attachable mounting means for a shelf element 62 located to the side of dispenser 64. The dispenser 64 includes a pair of forwardly extending posts 64*a* (one shown) differing in form and dimensions from those previously described but the mounting means is equally adapted to engage the posts 12*a*. The mounting means comprises a pair of vertical arms 66, to the lower end of at least one of which is attached the shelf element 62. A pair of short arms 68 project horizontally from the upper extremities of the vertical arms and are interconnected by the angular, slightly flexible cross-piece 70. The arms 68 and cross-piece 70 bear upon the upper marginal area 64*a* of the dispenser. A tab element 32 engages the rear surface of the dispenser as previously described. A second angular cross-piece 73 is fastened to the lower extremities of the vertical arms 66. Intermediate of the extremities of the vertical arms 66 there is provided means for varying the spacing between the arms for accomodating two dispenser posts (12*a* or 64*a*) of relatively different thickness. The illustrated camming means includes the angular arm section 66*a* and the slidable ring 74. Other means such as thumbscrew clamping means may be employed for a similar purpose. In this example the forward position of the vertical arms 66 is fixed by contact of the innermost arm with the ring portion of a stud member 24 which it may be assumed has been inserted in the bore of post 64*a*. The horizontal arm 76 illustrates a possible interconnection with a similar mounting means engaging the other dispenser post 64 (not shown). The device is installed by sliding it downwardly and rearwardly into position, the ring 74 then being moved to adjust the spacing of the vertical arms 66 relative to post 64*a*. The angular cross-pieces 70 and 73 may then be pinched or opened as the need may be.

Figure 8:
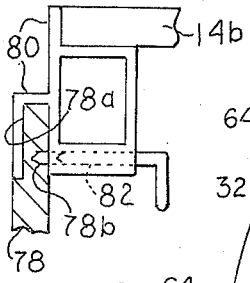
FIG. 8 is a side view of alternate attaching means.

FIG. 8 shows a simplified mounting of a shelf element 14*b* as a releasable attachment positioned above a toilet-tissue dispenser 78. However, a slight preliminary modification of the dispenser 78 is necessary to provide slotted portions 78*a* and 78*b*. Furthermore, the device is adapted to support objects of only moderate weight. An angular arm 80, firmly attached to shelf element 14*b*, engages the slotted portion 78*a* of the dispenser. Locking means in the form of a slidable pin or bolt is adapted to engage the tapered slot 78*b* in the dispenser. A pair of the mounting means illustrated may be included advantageously, that is one at each transverse end of the shelf element 14*b*.

In the examples of FIGS. 1 and 4, the extremities of arms 22 and 22*a* may, of course, be attached to other portions of the shelf elements 14 and 14*a*, e.g., forwardly of those shown as, for example at locations 14*b* and 14*c*, to provide a greater rigidity.

It will be apparent that an interchange of certain of the means shown in the several examples is readily possible. The arms 22 and stud members 24 may be so constructed that stud members having eyelet portions of different diameter can be threaded or snapped into the arms to accomodate to dispensers having bores of varying diameter.

The mounting means may suitably be composed of metal components, stamped as unitary pieces or welded together, The shelf element may be in the form of an injection molded piece of a plastic composition or a plastic on a metal frame to which the arms are attached. Components such as braces, gussets and the like may be added to provide further strength.

It is to be noted as an important feature that the support means are so fastened to edge or marginal portions of the shelf element as to leave the sides and surface areas thereof unobstructed for ready placement and removal of items carried thereby. This is especially important relative to the device of FIGS. 4 and 6 where the location of the shelf element may prevent it from being readily visible. Where it is desired to hold an item fixedly on the shelf element, as for manipulation of a part or removal of its contents, one or more of the wall portions may be formed or additional holding means be included for the purpose.

It will be understood that the subject invention may be practiced or embodied in other ways without departing from the character or spirit thereof. The preferred embodiment described herein is to be regarded, therefore, as illustrative and not restrictive, the scope thereof being indicated by the appended claims, and all variations which come within the meaning of the claims are intended to be embraced therein.

I claim:

1. A shelf-supporting device for attachment to a conventional toilet-tissue dispenser of a type having a pair of forwardly extending posts with bore portions formed therein for accepting the extremities of a spindle bearing a roll of toilet-tissue, said device comprising:

a shelf element of given area and shape adapted to be positioned horizontally and mount thereon at least one object;

means incorporated with said shelf element for holding said object against inadvertent displacement;

a plurality of rigid arm means at least one end of which is attached to and projects angularly from marginal portions of said shelf element for releasably engaging at least one given portion of the dispenser; the location of the attachment of said arm means and the angle of their disposition enabling the surface of said shelf element to be substantially free of obstruction for ready placement, removal or manipulation of said object;

means for holding a rear surface of said supporting device at a position adjacent to a rear surface of said dispenser whereby said shelf element is established at a horizontal position and substantially fixed against movement; and means for locking said supporting device at said position.

2. A shelf-like supporting device as defined in claim 1 wherein said arm means are adapted to engage given portions of the forwardly-extending posts of the dispenser.

3. A shelf-like supporting device as defined in claim 1 wherein that end of each said arm means which is opposite to said one end thereof is in the form of a grommet-like element adapted at a first part to engage one of said bore portions and at a second part to accept a spindle extremity.

4. A shelf-like supporting device as defined in claim 1 wherein said arm means includes at least one pair of rigid elongated members which project substantially vertically downwardly from at least one marginal portion of said shelf element and are adapted to bear against the sides of at least one of said forwardly-extending posts, said shelf 4(cont.) element thereby being positioned above said roll of toilet-tissue.

5. A shelf-like supporting device as defined in claim 4 but wherein said elongated members project upwardly, said shelf element thereby being positioned below said roll.

6. A shelf-like supporting device as defined in claim 1 wherein are included horizontally disposed positioning means bearing upon at least one given portion of said dispenser for establishing the plane of said shelf element with respect to said roll of toilet-tissue.

7. A shelf-like supporting device as defined in claim 1 wherein are included pairs of said arm means adapted to engage both of the forwardly-extending posts of the dispenser, said shelf element lying laterally between said arm means.

8. A shelf-like supporting device as defined in claim 1 wherein said shelf element is so connected to said arm means as to extend laterally to one side of said dispenser.

9. A shelf-like supporting device as defined in claim 2 wherein the spacing between arm means is adjustable to accomodate to relatively different forms and dimensions of said posts of the dispenser.

10. A shelf-like supporting device as defined in claim 3 wherein said grommet-like element is releasably attached to said arm means and may be replaced by another of different dimensions to accomodate to bores in the dispenser posts or spindles of varying dimensions.

* * * * *